US005979167A

United States Patent [19]

Kochavi et al.

[11] Patent Number: 5,979,167

[45] Date of Patent: Nov. 9, 1999

[54] CENTRAL AIR CONDITIONING SYSTEM

[75] Inventors: Dov Kochavi; Andre Golan, both of Raanana, Israel

[73] Assignee: Acclim-Line Ltd., Raanana, Israel

[21] Appl. No.: 08/783,761

[22] Filed: Jan. 15, 1997

[30] Foreign Application Priority Data

Jan. 15, 1996 [IL] Israel ..... 116764

[51] Int. Cl.[6] ..... F25D 17/04

[52] U.S. Cl. ..... 62/186; 62/187; 62/203; 62/510

[58] Field of Search ..... 62/186, 187, 160, 62/203, 204, 510

[56] References Cited

U.S. PATENT DOCUMENTS

| | | | |
|---|---|---|---|
| 2,259,780 | 10/1941 | Seid | 62/186 |
| 4,201,065 | 5/1980 | Griffin | 62/510 |
| 4,406,397 | 9/1983 | Kamata et al. . | |
| 4,635,445 | 1/1987 | Otsuka et al. . | |
| 4,635,455 | 1/1987 | Oliver . | |
| 4,976,116 | 12/1990 | Hayama et al. | 62/510 X |
| 4,997,030 | 3/1991 | Goto et al. . | |
| 5,076,344 | 12/1991 | Fields et al. . | |
| 5,247,806 | 9/1993 | Ebisu et al. . | |
| 5,413,165 | 5/1995 | Wylie | 62/186 X |

FOREIGN PATENT DOCUMENTS 37306 3/1995 Israel .

OTHER PUBLICATIONS

VVT System, Carrier Publication No. 13301, Aug. 20, 1990.

*Primary Examiner*—Henry Bennett
*Assistant Examiner*—Marc Norman
*Attorney, Agent, or Firm*—Abelman, Frayne & Schwab

[57] ABSTRACT

The present invention discloses an air conditioning system including at least first and second compressors, at least first and second heat exchangers associated respectively with the at least first and second compressors, at least third and fourth heat exchangers in refrigerant fluid communication respectively with the at least first and second heat exchangers, the at least third and fourth heat exchangers also being in heat exchange communication with a stream of air to be conditioned, an air flow pathway arranged to receive the stream of air downstream of the third and fourth heat exchangers and to direct it to a plurality of enclosures via a plurality of air outlets, and a control system operative to selectably operate the at least first and second compressors, such that none, all or some of the at least first and second compressors operate at a given time.

11 Claims, 12 Drawing Sheets

CENTRAL AIR CONDITIONING SYSTEM

FIELD OF THE INVENTION

The present invention relates to air conditioning systems in general and to central air conditioning systems in particular.

BACKGROUND OF THE INVENTION

Various central air conditioning systems are known in the art which provide conditioned air to a plurality of rooms wherein the temperature of each of the rooms may be controlled independently.

One such prior art attempt is the VVT System marketed by the Carrier Corporation of Minnville, Tenn. in the United States and described in the Carrier publication No. 13301 of Aug. 20, 1990. The VVT System divides the rooms to be air conditioned into a number of zones and controls the amount of conditioned air entering each zone by means of controllable dampers operating in response to the temperature in each of the zones.

As the temperature in each of the rooms changes, the dampers are opened or closed accordingly, thereby maintaining a desired temperature in each of the rooms or zones. If several of the rooms or zones are at the desired temperature, the dampers to these rooms are closed, thereby preventing the flow of conditioned air into these rooms. The dampers leading to the rooms which are not at the desired temperature are opened and the flow of conditioned air is directed to those rooms only. As long as there is a requirement for conditioned air from any of the rooms, the compressor of the heat pump must operate, thereby consuming substantial amounts of electrical energy. The excess thermal capacity of the compressor when operating under such part load conditions is wasted Another such prior art device is described in U.S. Pat. No. 4,635,455 to Otsuka et al. The Otsuka prior art device measures the heat load in each room by means of temperature sensors and controls the quantity of air to be directed to each room by means of variable dampers. The pressure in the main air duct is also measured and the speed of the blower adjusted accordingly. Under part load conditions, the speed of the compressor is reduced so as to conserve energy.

As in know in the art, operation of a compressor at reduced speeds results in inefficient operation of the compressor as well as requiring an expensive speed controller for controlling the speed of the electric motor which drives the compressor. Furthermore, a compressor capable of operating at a number of different speeds or over a continuous speed range is more costly than a compressor designed to operate at a single speed.

SUMMARY OF THE INVENTION

The present invention seeks to provide an air conditioning system which overcomes the drawbacks of the prior art devices and provides effective control of the temperature in each of the air conditioned rooms.

There is thus provided in accordance with a preferred embodiment of the present invention, a central air conditioning system including at least first and second compressors, at least first and second heat exchangers associated respectively with the at least first and second compressors, at least third and fourth heat exchangers in refrigerant fluid communication respectively with the at least first and second heat exchangers, the at least third and fourth heat exchangers also being in heat exchange communication with a stream of air to be conditioned, an air flow pathway arranged to receive the stream of air downstream of the third and fourth heat exchangers and to direct it to a plurality of enclosures via a plurality of air outlets, and a control system operative to selectably operate the first and second compressors, such that none, all or some of the at least first and second compressors operate at a given time.

Additionally in accordance with a preferred embodiment of the present invention, the plurality of outlets are equipped with individually controllable dampers and the control system also selectably operates the individually controllable dampers.

Still further in accordance with a preferred embodiment of the present invention, the control system operates the individually controllable dampers at least partially in response to the relationship between the heat loads in the plurality of enclosures.

Further in accordance with a preferred embodiment of the present invention, the control system selectably operates the at least first and second compressors at least partially responsive to the total heat load in the plurality of enclosures.

Still further in accordance with a preferred embodiment of the present invention, the central air conditioning system also includes a variable speed air blower assembly operative to force air past the at least third and fourth heat exchangers.

Further in accordance with a preferred embodiment of the present invention, the control system is operative to control the speed of operation of the first variable speed air blower at least partially in response to the total heat load in the plurality of enclosures.

Additionally in accordance with a preferred embodiment of the present invention, the central air conditioning system also includes a second variable speed air blower assembly operative to force air past the at least first and second heat exchangers.

Still further in accordance with a preferred embodiment of the present invention, the control system is operative to control the speed of operation of the second variable speed air blower at least partially in response to the total heat load in the plurality of enclosures.

There is also provided in accordance with another preferred embodiment of the present invention an air conditioning system including at least one compressor, at least one first heat exchanger associated with the at least one compressor, at least one second heat exchanger in refrigerant fluid communication respectively with the at least first heat exchanger, the at least one second heat exchanger also being in heat exchange communication with a stream of air to be conditioned, an air flow pathway arranged to receive the stream of air downstream of the at least second heat exchanger and to direct it to a plurality of enclosures via a plurality of air outlets equipped with individually controllable dampers, and a control system operative to selectably operate the at least one compressor and said individually controllable dampers, at least partially in response to the relationship between the heat loads in the plurality of enclosures.

Additionally in accordance with a preferred embodiment of the present invention, the control system selectably operates the at least one compressor at least partially in responsive to the total heat load in the plurality of enclosures.

Still further in accordance with a preferred embodiment of the present invention, the central air conditioning system also includes a first variable speed air blower assembly operative to force air past the at least one second heat exchanger.

Still further in accordance with a preferred embodiment of the present invention, the control system also includes a data port communicating with the control system to permit external programming and monitoring of the operation thereof.

BRIEF DESCRIPTION OF THE DRAWINGS

The present invention will be understood and appreciated from the following detailed description, taken in conjunction with the drawings in which.

DETAILED DESCRIPTION OF PREFERRED EMBODIMENTS

Figure 1:
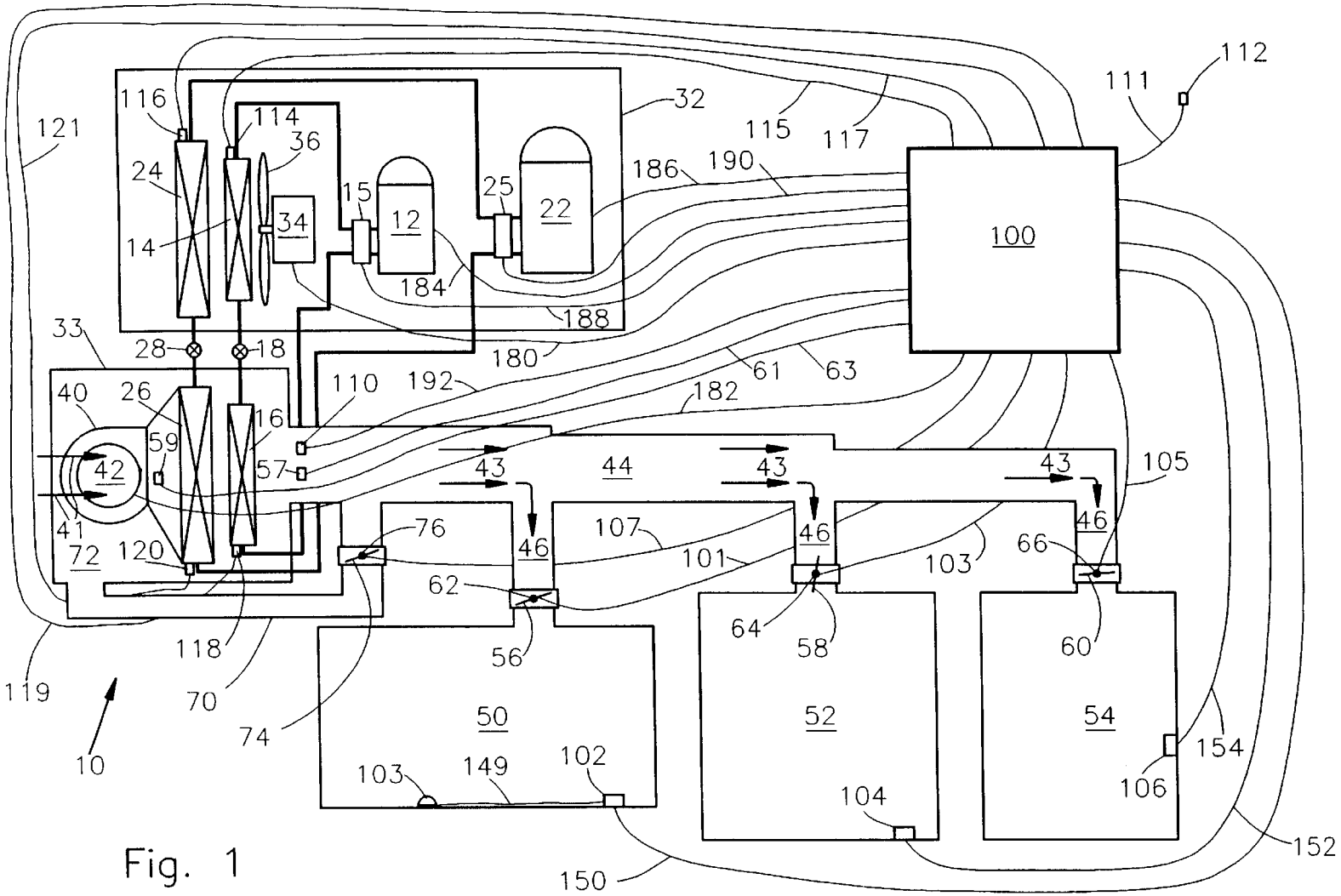
FIG. 1 is a schematic illustration of a central air conditioning system constructed and operative in accordance with a preferred embodiment of the present invention.

Reference is now made to FIG. 1 which is an illustration of a central air conditioning system constructed and operative in accordance with a preferred embodiment of the present invention.

The air conditioning system 10 of the present invention comprises a first compressor 12 in fluid communication with a first heat exchanger 14. A first changeover valve 15 is interposed between the first compressor 12 and the first heat exchanger 14 to allow operation of the air conditioning system 10 for 'summer operation' and 'winter operation' as is known in the art. A third heat exchanger 16 is in fluid communication with the first heat exchanger 14 and a first expansion valve 18 is interposed between the first heat exchanger 14 and the third heat exchanger 16. The third heat exchanger 16 is in turn in fluid communication with the first changeover valve 15. The first changeover valve 15 is in turn in fluid connection with the first compressor 12, thereby establishing a first refrigeration circuit.

The air conditioning system 10 also comprises a second compressor 22 in fluid communication with a second heat exchanger 24. A second changeover valve 25 is interposed between the second compressor 22 and the second heat exchanger 24 to allow operation of the air conditioning system 10 for 'summer operation' and 'winter operation'. A fourth heat exchanger 26 is in fluid communication with the second heat exchanger 24 and a second expansion valve 28 is interposed between the second heat exchanger 24 and the fourth heat exchanger 26. The fourth heat exchanger 26 is in turn in fluid communication with the second changeover valve 25. The second changeover valve 25 is in turn in fluid connection with the second compressor 22, thereby establishing a second refrigeration circuit.

The first heat exchanger 14 and the third heat exchanger 24 are mounted in a case 32 which is generally located in a region accessible to the ambient air. Also mounted in case 32 is an external fan motor 34 drivingly connected to an external fan 36. As may be seen in FIG. 1, the first heat exchanger 14 and the third heat exchanger 24 are disposed so that the air flow generated by the external fan 32 passes through the first heat exchanger 14 and the third heat exchanger 24.

The first compressor 12, the second compressor 22, the first changeover valve 15 and the second changeover valve 25 are also generally mounted in the case 32. The first expansion valve 18 and the second expansion valve 28 may also be mounted in the case 32 but the expansion valves are shown external to the case 32 in FIG. 1 for the sake of clarity.

A blower 40, drivingly connected to a blower motor 42, is disposed to direct a flow of air to be conditioned so that the air flow generated by the blower 40 passes through the fourth heat exchanger 26 and the third heat exchanger 16 and into a main air distribution duct 44. The main duct 44 in turn distributes the now conditioned air 43 through a plurality of branch ducts 46 to a plurality of rooms 50, 52 and 54 via variable dampers 56, 58 and 60 respectively. Each of the variable dampers 56, 58 and 60 is drivingly connected to a damper motor 62, 64 and 66 respectively.

It is apparent that the blower 40 may also be placed in proximity to and downstream of the fourth heat exchanger 26 and the third heat exchanger 16.

The embodiment of FIG. 1 is described in terms of three rooms 50, 52 and 54. It is be apparent to one skilled in the art that this is by way of example only and the number of rooms to be provided with conditioned air is not limiting. It is also apparent that if additional rooms are to be provided with conditioned air, additional ducts and variable dampers are provided to these rooms as well.

The air conditioning system 10 also comprises an air flow pressure sensor 110 which may be located at the entrance to the main duct 44. The air flow pressure sensor 110 may be an NT. 2322-640-56272 manufactured by the Philips Corporation of Holland or any other sensor suitable for measuring the air pressure at the entrance to the main duct 44. The air flow sensor 110 is operative to send a duct pressure signal to the control system 100 which is substantially proportional to the air pressure at the entrance to the main duct 44.

A bypass duct 70 may be disposed near the downstream end of the third heat exchanger 16 to provide a flow path for the conditioned air from the main duct 44 and return it to an entrance region 72 located in proximity to the upstream end of the blower 40. A bypass damper 74 which is drivingly connected to a bypass damper motor 76 is interposed in the bypass duct 70. The bypass damper 74 is operative, in response to signals from the control system 100, to return some or all of the conditioned air to the entrance region 72 if the pressure sensed by air flow pressure sensor 110 exceeds a value which may be in the region of 16 to 19 psi and is preferably about 17 psi.

Return air ducts may also be provided between the rooms 50, 52 and 54 and the entrance region 72. The return air ducts are not shown in FIG. 1.

A control system 100, which may be a conventional microprocessor based controller, is electrically connected to the first compressor 12 by a first compressor control wire 184. The control system 100 is also electrically connected to the second compressor 22 by a second compressor control wire 186.

The control system 100 is also electrically connected to the blower motor 42 by blower motor control wire 182 and to the external fan motor 34 by a fan control wire 180.

The control system 100 is also electrically connected to the first changeover valve 15 by a first changeover valve control wire 188 and to the second changeover valve 25 by a second changeover valve control wire 190.

The control system is also electrically connected to the damper motors 62, 64 and 66 via damper motor control wires 101, 103 and 105 respectively. The control system 100 may also be electrically connected to the bypass damper motor 76 via bypass damper motor control wire 107.

The control system 100 is operative to activate the first compressor 12, the second compressor 22, the first changeover valve 15, the second changeover valve 25, the external fan motor 34, the blower motor 42, the damper motors 62, 64 and 66 and the bypass damper motor 76 in response to input signals as will be described hereinbelow.

The control system 100 is also electrically connected to room temperature controllers 102, 104 and 106 in each of the rooms 50, 52 and 54 via room controller wires 150, 152 and 154 respectively. The room temperature controllers 102, 104 and 106 may also be electrically connected to a conventional motion sensor 103, such as a conventional IR sensor for detecting movement in the rooms 50, 52 and 54, via motion sensor wire 149. The motion sensor 103 is shown in FIG. 1 in room 50 but it is apparent that the motion sensor 103 may be installed in the other rooms as well. The motion sensor 103 is operative to provide a signal to the room controller 102 depending on the existence or absence of an individual in the room 50.

The control system 100 is also electrically connected to the air flow pressure sensor 110 via air flow pressure wire 192.

The control system 100 is also electrically connected to a duct temperature sensor 57 via duct temperature sensor wire 61. The duct temperature sensor 57 may be placed in the main duct 44 in proximity to and downstream of the second heat exchanger 16. The duct temperature sensor 57 is operative to send a signal to the control system 100 substantially proportional to the temperature of the air in the main duct 44.

The control system 100 is also electrically connected to an entrance region temperature sensor 59 via an entrance region temperature sensor wire 63. The entrance region temperature sensor 59 may be placed in the proximity to and downstream of the blower 40. The entrance region temperature sensor 59 is operative to send a signal to the control system 100 substantially proportional to the temperature of the air immediately downstream of the blower 40.

It is be apparent that the entrance region temperature sensor 59 measures the temperature of the air flow before it passes through the fourth heat exchanger 26 and the third heat exchanger 16 and that the duct temperature sensor 57 measures the temperature of the air flow after it has passed through the fourth heat exchanger 26 and the second heat exchanger 16.

The control system 100 may also be electrically connected to an outside temperature sensor 112 via an outside temperature sensor wire 111. The outside temperature sensor 112 may be located in any convenient location where it is exposed to the ambient air and is operative to send an outside temperature signal to control system 100 substantially proportional to the temperature of the ambient air.

The control system 100 may also be electrically connected to a first temperature sensor 114 via a first temperature sensor wire 115. The first temperature sensor 114 may be located in proximity to the entrance of refrigerant into the first heat exchanger 14 and is operative to send a first heat exchanger temperature signal to the control system substantially proportional to the temperature of the refrigerant as it enters the first heat exchanger 14.

The control system 100 may also be electrically connected to a second temperature sensor 116 via a second temperature sensor wire 117. The second temperature sensor 116 may be located in proximity to the entrance of refrigerant into the second heat exchanger 24 and is operative to send a second heat exchanger temperature signal to the control system substantially proportional to the temperature of the refrigerant as it enters the second heat exchanger 24.

The control system 100 may also be electrically connected to a third temperature sensor 118 via a third temperature sensor wire 119. The third temperature sensor 118 may be located in proximity to the exit of refrigerant from the third heat exchanger 16 and is operative to send a third heat exchanger temperature signal to the control system substantially proportional to the temperature of the refrigerant as it leaves the third heat exchanger 16.

The control system 100 may also be electrically connected to a fourth temperature sensor 120 via a fourth temperature sensor wire 119. The fourth temperature sensor 120 may be located in proximity to the exit of refrigerant from the fourth heat exchanger 26 and is operative to send a fourth heat exchanger temperature signal to the control system substantially proportional to the temperature of the refrigerant as it leaves the fourth heat exchanger 16.

It is understood that the reference to entrance and exit of refrigerant from the first, second, third and fourth heat exchangers pertains to operation of the air conditioning system 10 for providing cooling air during 'summer operation' and that the flow of refrigerant is reversed when the air conditioning system 10 is operative to provide heated air during 'winter operation'.

Figure 2:
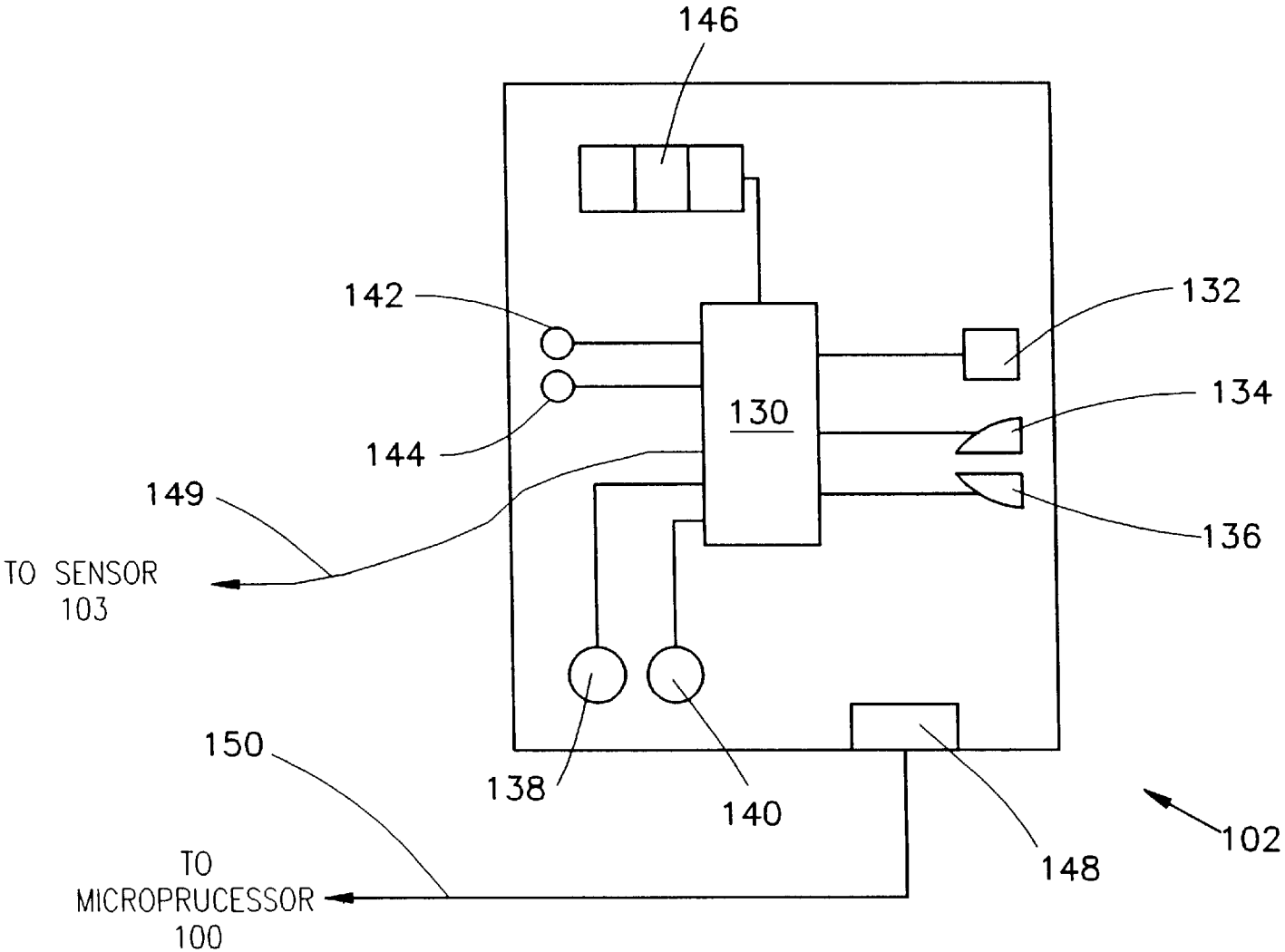
FIG. 2 is a schematic illustration of a room temperature controller useful in the central air conditioning system of FIG. 1.

Reference is now made to FIG. 2 which is a schematic illustration of a room temperature controller 102 useful in the central air conditioning system of FIG. 1. Room temperature controllers 104 and 106 are substantially identical to room controller 102 and reference is made to room controller 102 by way of example only.

Room temperature controller 102 comprises a first microprocessor 130 which may be a Motorola 6085 P9 microprocessor or any other suitable microprocessor. Room temperature controller 102 also comprises a first control switch 138 operative to send an ON/Enter signal to the microprocessor 130 and a second control switch 140 operative to send an OFF signal to the microprocessor 130. Room temperature controller 102 also comprises an increasing switch 134 and a decreasing switch 136. Switches 134 and 136 are operative to send an increasing and a decreasing temperature signal respectively to the microprocessor 130.

The increasing switch 134, the decreasing switch 136, the first and second control switches 138 and 140 are connected to input ports of the microprocessor 130 as is known in the art.

The first control switch 138, the second control switch 140, the increasing and decreasing switches 134 and 136 may also be operative to send programming signals to the microprocessor 130 as is known in the art.

Room temperature controller 102 also comprises a room temperature sensor 132. Room temperature sensor 132 may be a conventional thermistor sensor such as model TRMF001A manufactured by Morate of Kyoto, Japan or any other suitable temperature sensing device. Room temperature sensor 132 is operative to send a temperature signal RoomHeat[50] to the first microprocessor 130 which is substantially proportional to the temperature in the room 50.

The motion sensor wire 149 may also be connected to an input port of the first microprocessor 130.

Electrically connected to output ports of microprocessor 130 is a first bi-color LED 142 and a second bi-color LED 144. The first and second bi-color LED's are operative to display a red or green color in response to output signals from the first microprocessor 130.

A triad of seven segment LED displays 146 are also electrically connected to output ports of the first microprocessor 130 as is know in the art. The seven segment LED's are operative, in response to signals from the first microprocessor 130, to display information to the user, such information including the actual room temperature, the desired room temperature and various status signals. The seven segment LED's may also operative to display programming information as is well known in the art.

The room thermostat 102 is electrically connected to the +5 V power supply and to the ground of the control system 100. The +5 V and ground connections are not shown in FIG. 2. A room controller communications line 150 is electrically connected to the control system 100 and is operative to transmit information collected by the room controller 102 and provide this information to the control system 100.

The first microprocessor 130 is operative to process information received from the room temperature sensor 132, increasing switch 134, decreasing switch 136, the first and second control switches 138 and 140 and the motion sensor 103 and encode this information in a conventional pulse width modulated (PWM) room controller signal and to transmit this room controller signal to the control system 100 via room controller communications line 150. Pulse Width Modulated communications techniques are well known in the art and are described in the data sheet LXT 305 published by the Level One Communication Corporation of Folsom, Calif., the contents of which are hereby incorporated by reference.

It is appreciated that room controllers 104 and 106 are operative to send a similar PWM encoded signal regarding conditions in the room 52 and 54 to the control system 100, including the temperature signals RoomHeat[52] and RoomHeat[54].

Figure 3:
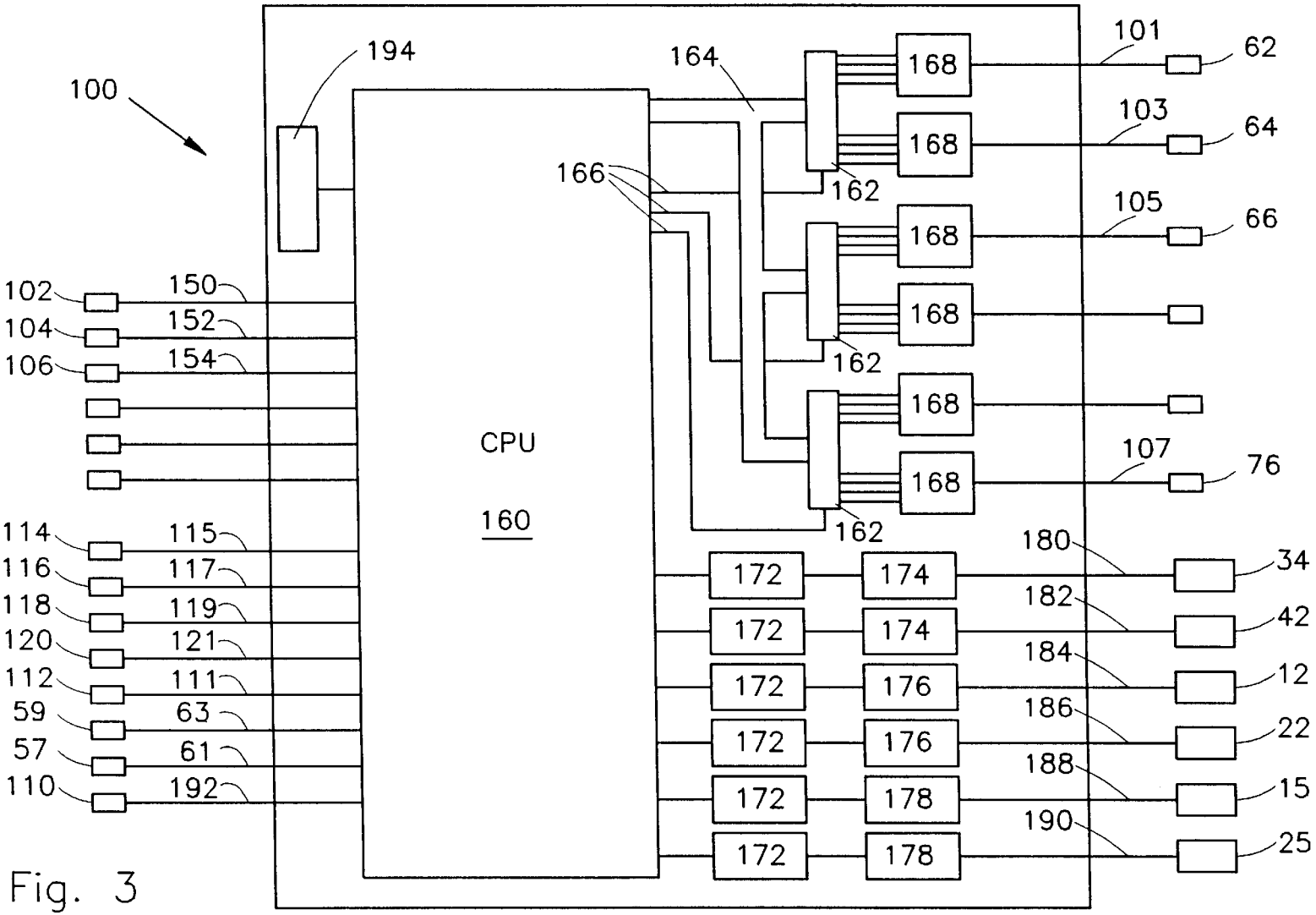
FIG. 3 is a schematic illustration of a control system useful in the central air conditioning system of FIG. 1.

Reference is now made to FIG. 3 which is a schematic illustration of the control system 100 useful in the central air conditioning system of FIG. 1. The control system 100 comprises a second microprocessor 160 which may be a Motorola 6805 B16 microprocessor or any other suitable microprocessor.

The room controllers 102, 104 and 106 are electrically connected to input ports of the second microprocessor 160 via room controller communications lines 150, 152 and 154 respectively. The second microprocessor 160 is operative to decode the pulse width modulated signals sent by the room controllers 102, 104 and 106 by conventional PWM decoding techniques as described in the data sheet LXT 305, referenced hereinabove.

The second microprocessor 160 is also operative to decode the increasing signals and the decreasing signals received from each of the room controllers 102, 104 and 106, and to accumulate the increasing and decreasing signals in memory locations RoomDspHeat[50], RoomDspHeat[52] and RoomDspHeat[54].

It is apparent to one skilled in the art that the increasing signals and the decreasing signals may be accumulated in the first microprocessor 130 and interpreted as the desired temperature in each of the rooms 50, 52 and 54. It is also be apparent to one skilled in the art that the first microprocessor is operative to transmit the desired temperature to the control system 100.

The second microprocessor 160 is also operative to decode the temperature signals received from the room controllers 102, 104 and 106 and to store these values in memory locations RoomHeat[50], RoomHeat[52] and RoomHeat[54].

It is apparent to one skilled in the art that applying names to locations in memory that are indicative of the contents of the memory location is well known. Thus for example, the memory location identified by RoomHeat [50] contains a numerical value which is substantially equal to the temperature of room 50.

It is appreciated that the memory locations RoomsDispHeat[50], RoomsDispHeat[52] and RoomsDispHeat[54] contain values which represent the desired temperature of the rooms 50, 52 and 54. It is also appreciated that the memory locations RoomHeal[50], RoomHeat[52] and RoomHeat[54] represent the actual temperature of room 50, 52 and 54, respectively.

In addition to the above devices connected to input ports of the second microprocessor 160, the first temperature sensor 114 is connected to an analog input port of the second microprocessor 160 via first temperature sensor wire 115. The second temperature sensor 116 is also connected to an analog input port of the second microprocessor 160 via the second temperature sensor wire 117. The third temperature sensor 118 is also connected to an analog input port of the second microprocessor 160 via the third temperature sensor wire 119. The fourth temperature sensor 120 is also connected to an analog input port of the second microprocessor 160 via the fourth temperature sensor wire 121. The outside temperature sensor 112 is also connected to an analog input port of the second microprocessor 160 via the outside temperature sensor wire 111. The entrance region temperature sensor 59 is also connected to an analog input port of the second microprocessor 160 via the entrance region temperature sensor wire 63. The duct temperature sensor 57 is also connected to an analog input port of the second microprocessor 160 via the duct temperature sensor wire 61. The air flow pressure sensor 110 is also connected to an analog input port of the second microprocessor 160 via the air flow pressure sensor wire 192.

The second microprocessor 160 is operative to convert the analog signals received from the first temperature sensor 114, the second temperature sensor 116, the third temperature sensor 118, the fourth temperature sensor 120, the outside temperature sensor 112, the duct temperature sensor 57, the entrance region temperature sensor 59 and the air flow pressure sensor 110 into digital values suitable for digital processing by the second microprocessor 160.

The control system 100 also comprises a data bus 164 electrically connected to output ports of the second microprocessor 160 and to a plurality of output circuits 162. Each output circuit 162 is also electrically connected to a chip select wire 166 which is in turn electrically connected to an output port of the second microprocessor 160. Each output circuit 162 is also electrically connected to a pair of bi-polar damper motor controllers 168. Each damper motor controller 168 is also electrically connected to a damper control motor. As seen in FIG. 3, the damper motor 62 is electrically connected to one of the bi-polar damper motor controllers 168 via the damper control wire 101. Similarly, the damper motors 64, 66 and the bypass damper motor 76 are electrically connected to one of the bi-polar damper motor controllers 168 via the damper control wires 103, 105 and the bypass damper control wire 107, respectively.

The second microprocessor 160 is operative to selectively open or close the dampers 56, 58, 60 and the bypass damper 74 via the damper motors 62, 64, 66 and the bypass damper motor 76, the damper control wires 101, 103, 105 and the bypass damper motor control wire 107, the bi-polar damper motor controllers 168 and the output circuits 162 in response to data generated by the second microprocessor 160 and placed on the data bus 164 and by data generated by the second microprocessor 160 and placed on the chip select wires 166.

It is appreciated that the method of controlling the dampers 56, 58, 60 and the bypass damper 74 are based on conventional techniques well known in the art. It is also appreciated that the control system 100 may be operative to control any number of dampers.

The control system 100 also comprises a plurality of opto-couplers 172 each connected to an output port of the second microprocessor 160. The opto-couplers 172 may be conventional opto-couplers such as the Motorola MOC 3041 or any other suitable opto-coupler.

The control system 100 also comprises a pair of conventional triacs 174 each of which is electrically connected to one of the opto-couplers 172. As seen in FIG. 3, one of the triacs 174 is also electrically connected to the external fan motor 34 via external fan motor wire 180 and the second of the pair of triacs 174 is electrically connected to the blower motor 42 via blower motor wire 182.

The control system 100 is operative to control speed of rotation of the external fan motor 34 and the blower motor 42 in response to signals generated by the second microprocessor 160 via the opto-couplers 172, the triacs 174, the external fan motor wire 180 and the blower motor wire 182.

The control system 100 also comprises a first pair of conventional contactors 176 each of which is electrically connected to one of the opto-couplers 172. As seen in FIG. 3, one of the first pair of contactors 176 is also electrically connected to the first compressor 12 via the first compressor control wire 184 and the second of the first pair of contactors 176 is electrically connected to the second compressor 22 via the second compressor wire 186.

The control system 100 is operative to control the ON or OFF state of the first compressor 12 and the second compressor 22 in response to signals generated by the second microprocessor 160 via the opto-couplers 172, the contactors 176, the first compressor control wire 184 and the second compressor control wire 186.

The control system 100 also comprises a second pair of conventional contactors 178 each of which is electrically connected to one of the opto-couplers 172. As seen in FIG. 3, one of the second pair of contactors 176 is also electrically connected to the first changeover valve 15 via the first change control wire 188 and the second of the second pair of contactors 178 is electrically connected to the second changeover valve 25 via the second changeover valve 190.

The control system 100 is operative to control the state of the first changeover valve 15 and the second changeover valve 25 in response to signals generated by the second microprocessor 160 via the opto-couplers 172, the second pair of contactors 178, the first changeover valve control wire 188 and the second changeover valve control wire 190.

Control system 100 also comprises a serial port 194 which is operative to provide serial communications between the second microcomputer 160 and an external computer. The serial port 194 may also be electrically connected to a modem (not shown in FIG. 3) for remote communications to an external computer. Serial output port 194 may operate according to a standard serial communication protocol such as RS-232 or any other suitable serial communications protocol.

The second microprocessor 160 is operative to receive control variables used in controlling operation of the air conditioning system 10 from the serial port 194 and to store these control variables in memory as is well known in the art.

Alternatively or in addition, the second microprocessor 160 may also be operative to store control variables generated by the room controllers 102, 104 and 106 in memory as is well known in the art.

The following control variables used to control operation of the air conditioning system 10 of FIG. 1 are stored in non-volatile memory of the second microprocessor 160:

RoomCmpVol[50] represents the thermal load of room 50 and includes the size, exposure, number of occupants, thermal properties of the walls, ceiling and floor as well as other factors normally used to determine the thermal load of room 50. Similarly, RoomCmpVol[52] and RoomCmpVol[54] represents the thermal load of rooms 52 and 54 respectively.

The thermal loads of the rooms are normalized on a scale of 0 to 20. A value of 0 means that the room has no thermal load while a value of 20 means that the room has the highest thermal load. It is appreciated that small rooms with a small number of occupants is assigned low values of RoomCmpVol and large rooms with a large number of occupants is assigned large values of RoomCmpVol.

RoomVol[50] represents the air flow requirement of room 50 and includes the size, number of occupants and air leakage as well as other factors normally used to determine the air flow requirement of room 50. Similarly, RoomVol [52] and RoomVol[54] represent the air flow requirement of rooms 52 and 54 respectively.

The air flow requirements of the rooms are normalized on a scale of 0 to 20. A value of 0 means that the room has no air flow requirement while a value of 20 means that the room has the highest air flow requirement. It is appreciated that small rooms with a small number of occupants is assigned low values of Room Vol and large rooms with a large number of occupants is assigned large values of RoomVol.

MV1 represents a low compressor reference value used to determine if the first compressor 12 is turned ON and second compressor 22 is turned OFF. MV2 represents a high compressor reference value used to determine if both the first compressor 12 and the second compressor 22 are turned ON.

SlowFanVol represents a low blower reference value used to determine if the rotational speed of blower 40 is at a low blower speed. MidFanVol represents an intermediate blower reference value used to determine if the rotational speed of the blower 40 is at an intermediate blower speed.

DT represents a temperature hysteresis value for controlling the temperature in each of the rooms 50, 52 and 54 and is may be in the range of 1° C. to about 4° C. and is preferably about 2° C. Thus, if the desired temperature in a room is 22° C., and DT has a preferred value of 2° C., the room temperature is allowed to vary between 21° C. and 23° C., as described hereinbelow.

THi represents a reference value for the lowest useable temperature of the refrigerant that enters the third heat exchanger 16 as determined by the third temperature signal. THi may be in the range of 35° C. to about 60° C. and is preferably about 50° C. The control system 100 is operative to stop operation of the blower motor 42 when the air conditioning system 10 is first turned on until the temperature of the refrigerant as sensed by the third temperature signal reaches THi, thereby preventing air that has not been heated from entering the rooms.

EPPwrtM represents the minimum hold time before the status of either the first compressor 12 or the second compressor 22 is changed. Thus, for example, if the first compressor 12 has just been turned ON, it remains ON for at least EPPwrtM seconds, no matter what changes may occur in the thermal load of the air conditioning system 10. EPPwrtM may be in the range from 15 seconds to about 120 seconds and is preferably about 30 seconds.

The second microprocessor 160 is also operative to calculate and store the following variables in memory:

CMPVol represents the total thermal load of all the rooms and is calculated according to $$CMPVol = \sum_{i=50,52,54} RoomCmpVol[i] * f(i)$$

The function f(i) has the value of 0 or 1 and is described hereinbelow with reference to FIG. 9.

DamperStalus[50] represents the fraction opening of the damper 56. Thus, a value of 0 for DamperStatus[50] indicates that the damper 56 is closed and no flow of conditioned air enters room 50. A value of 1 for DamperStatus[50] indicates that the damper 56 is fully open thereby allowing a maximum flow of conditioned air into room 50.

Similarly, DamperStatus[52] represents the fraction opening of the damper 58 which controls the low of conditioned air into room 52 and DamperStatus[54] represents the fraction opening of the damper 60 which controls the flow of conditioned air into room 54.

RoomVolume represents the total air flow requirement of all the rooms and is calculated according to $$RoomVolume = \sum_{i=50,52,54} RoomVol[i]DamperStatus[i]$$

The control system 100 is operative to turn the first compressor 12 OFF and the second compressor 22 OFF if CMPVol=0

The control system 100 is also operative to turn the first compressor 12 ON and the second compressor 22 OFF if 0<CMPVol≦MV1

The control system 100 is also operative to turn the first compressor 12 OFF and the second compressor 22 ON if MV1<CMPVol≦MV2

The control system 100 is also operative to turn the first compressor 12 ON and the second compressor 22 ON if CMPVol>MV2

It is apparent that the control system 100 is operative to turn both compressors off when the thermal load of all the rooms is zero. It is also apparent that the control system 100 is operative to turn on the first compressor 12 when the total thermal load of all the rooms is greater than zero but less than the low compressor reference value MV1. It is also apparent that the control system 100 is operative to turn the second compressor 22 ON when the total thermal load is between the low compressor reference value MV1 and the high compressor reference value MV2. It is also apparent that the control system 100 is operative to turn on both the first compressor 12 and the second compressor 22 when the total thermal load of all the rooms is It is apparent to one skilled in the art that the electrical energy consumed by the air conditioning system 10 is substantially minimized by matching operation of the first compressor 12 and the second compressor 22 to the total thermal load of all the rooms.

The control system 100 is also operative to turn the blower motor 42 OFF if RoomVolume=0

The control system 100 is also operative to turn the blower motor 42 at a low blower speed if 0<RoomVolume≦SlowFanVol The low blower speed may be in the range of about 55% to 75% of the rated blower speed and is preferably about 65% of the rated blower speed.

The control system 100 is also operative to turn the blower motor 42 at an intermediate blower speed if SlowFatiVol<RoomVolume≦MidFanVol The intermediate blower speed may be in the range of 76% to 85% of the rated blower speed and is preferably about 80% of the rated blower speed.

The control system 100 is also operative to turn the blower motor 42 at a high blower speed if MidFanVol<Room Volume The high blower speed of blower motor 42 is generally equal to the maximum rated speed of the blower motor 34.

The maximum rated speed of the blower motor 34 depends on the type of fan 36 used and may be in the region of about 1000 rpm to 1500 rpm and is preferably about 1150 rpm.

It is apparent that the control system 100 is operative to turn blower motor 42 OFF if the total air flow requirement of all the rooms is zero. It is also apparent that the control system 100 is operative to rotate the blow motor at the low blower speed if the total air flow requirement of all the rooms is greater than zero but less than the low blower reference value SlowFanVol. It is also apparent that the control system 100 is operative to rotate the blower motor 42 at the intermediate blower speed if the total air flow requirement of all the rooms is greater than the low blower reference value SlowFanVol and less than the intermediate blower reference value MidFanVol. It is also apparent that the control system 100 is operative to rotate the blower motor 42 at the high blower speed if the total air flow requirement of all the rooms is greater than the intermediate blower reference value MidFanVol.

The control system 100 is also operative to control the fraction opening of the dampers 56, 58 and 60 and to store the value of the fraction opening of each of the dampers 56, 58 and 60 in memory locations DamperStatus[50], DamperStatus[52] and DamperStatus[54] corresponding to each of the rooms 50, 52 and 54 respectively.

Operation of the control system 100 for controlling the fraction opening of the damper, DamperStatus[i], for each of the rooms is now described in terms of heating for 'winter operation'. It is apparent to one normally skilled in the art that the teachings of the present invention are equally applicable to cooling in 'summer operation'.

The fraction opening of each of the dampers 56, 58 and 60 is given by $$DamperStatus[i] = \frac{[RoomDspHeat[i] + DT/2] - RoomHeat[i]}{DT}$$

wherein the DamperStatus[i] is limited to values between 0 and 1 where 0 indicates that the damper is completely closed and 1 indicates that the damper is fully open.

For example, if the temperature hysteresis is DT=2° C. and the desired temperature of room 50 is RoomDspHeat [50]=of 22° C. and the measured temperature of room 50 is RoomHeat[50]=20° C. then DamperStatus[50]=1. It is apparent therefore that if the measured room temperature in room 50 is less than the desired temperature by more than DT/2 degrees, then the damper 56 is fully open, thereby allowing conditioned air to enter the room 50, thereby raising the temperature of the air in room 50.

When the temperature of the air in room 50 reaches the desired value of RoomDspHeat[50]=22° C., then DamperStalus[50] is given by $$DamperStatus[50] = \frac{[22 + 2/2] - 22}{2} = \frac{1}{2}$$

in which case the control system 100 is operative to open the damper 56 to substantially 50% of its full opening, thereby decreasing the flow of conditioned air into room 50.

When the temperature of the air in room 50 reaches the upper limit of the hysteresis range, that is RoomDspHeat [50]+DT/2=23° C., then $$DamperStatus[50] = \frac{[22 + 2/2] - 23}{2} = 0$$

in which case control system 100 is operative to close the damper 56, thereby preventing additional conditioned air from entering room 50.

The control system 100 is also operative to adjust the speed of the external fan motor 34 in response to the third temperature signal received from the third heat exchanger 16 and the fourth temperature signal received from the fourth heat exchanger 26, to maintain the temperature range of the refrigerant entering the third heat exchanger 16 and the fourth heat exchanger 26 substantially within the range of 50° C. to 55° C. The method of controlling the temperature of the refrigerant by adjusting the speed of the external fan is well known in the art.

It is apparent that in the case of 'summer operation', the speed of the external fan motor 34 is adjusted in response to the first temperature signal received from the first heat exchanger 14 and the second temperature signal received from the second heat exchanger 24.

RoomState[i] represents the operational status of room i. RoomState[i] is assigned the following values:

$$\begin{aligned} RoomState[i] &= 0 \text{ if } Roomi \text{ is not currently being heated or} \\ &\quad \text{if there is no thermostat in } Roomi \\ &= 1 \text{ if } Roomi \text{ is being heated} \\ &= 2 \text{ if } Roomi \text{ has been set to OFF} \end{aligned}$$

The control system 100 is also operative to store the value of RoomState[i] for each of the rooms in response to the measured and desired temperature in the room i and the status of the ON/Enter switch 138 and the OFF switch 140 of the room controller for the room i.

Thus for example, if the measured temperature of room 50, RoomHeat[50] is below the desired temperature RoomDspHeat[50] minus the hysteresis value DT/2, control system 100 is operative to set RoomState[50] to 1, indicating that room 50 is to receive conditioned air. When the measured temperature of room 50 reaches or exceeds the desired temperature RoomDspHeat[50] plus the hysteresis value DT/2, control system 100 is operative to set RoomState[50] to 0, indicating that delivery of conditioned air to room 50 is to stop. RoomState[50] remains 0 until the temperature of room 50 falls to RoomDspHeat[50] minus DT/2, whence the control system 100 is operative to set RoomState[50] to 1 again.

It is apparent to one skilled in the art that the control system 100 is operative to maintain the temperature of each of the rooms i within a band of DT degress around the desired temperature of each room.

Also by way of example, if the OFF switch 140 has been activated in room 52, the control system 100 is operative to set RoomState[52]=2, indicating that room 52 is not to receive any conditioned air.

The control system 100 is also operative to decode and store the first temperature signal from the first temperature sensor 114 in memory location OutUHeat.

The control system 100 is also operative to decode and store the second temperature signal from the second temperature sensor 116 in memory location OutUHeatB.

The control system 100 is also operative to decode and store the third temperature signal from the third temperature sensor 118 in memory location InFanHeat.

The control system 100 is also operative to decode and store the fourth temperature signal from the fourth temperature sensor 120 in memory location InFanHeatB.

The control system 100 is also operative to decode and store the outside temperature signal from the outside temperature sensor 112 in memory location OutHeat.

The control system 100 is also operative to determine the desired ON or OFF state of the first compressor 12 and store the first compressor state in the variable OutUnitState. The variable OutUnitState may have one of the following values:

$$\begin{aligned} OutUnitState &= 0 \text{ if first compressor 12 is OFF} \\ &= 1 \text{ if first compressor 12 is in a WAIT state between OFF and ON} \\ &= 2 \text{ if first compressor 12 is operating} \end{aligned}$$

The control system 100 is also operative to determine the desired ON or OFF state of the second compressor 22 and store the second compressor state in the variable OutUnitStateB. The variable OutUnitStateB may have one of the following values:

$$\begin{aligned} OutUnitStateB &= 0 \text{ if second compressor 12 is OFF} \\ &= 1 \text{ if second compressor 12 is in a WAIT state between OFF and ON} \\ &= 2 \text{ if second compressor 12 is operating} \end{aligned}$$

It is appreciated that the term 'store in memory' and 'store a variable' are substantially the same.

Figure 4:
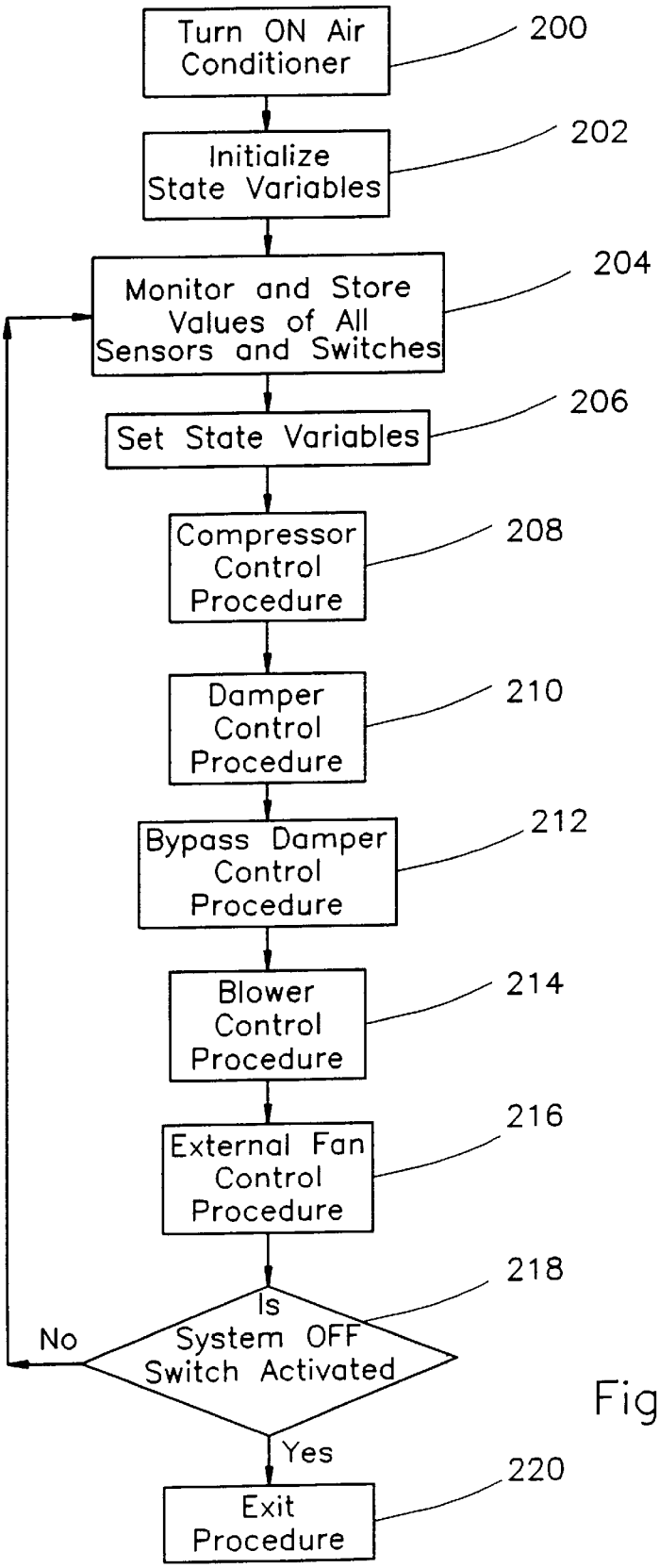
FIG. 4 is a simplified flow chart representing a portion of the main control program used to control operation of the air conditioning system of FIG. 1.

Reference is now made to FIG. 4 which is a simplified flow chart representing a portion of the main control program used to control operation of the air conditioning system of FIG. 1.

At step 200, the air conditioning system has been turned ON and in step 202 the state variables are initialized, and the control system 100 enters the main control loop at step 204. At step 204, the signals from all of the sensors are read and the values stored in appropriate locations in memory. Similarly, the PWM encoded signals from the room controllers 102, 104 and 116 are decoded and stored in appropriate locations in memory.

At step 206 the variable RoomState[i] is determined for each of the rooms 50, 52 and 54.

At step 208, the Compressor Control Procedure is called. Depending on the total thermal load of the system and the various state variables, the Compressor Control procedure is operative to turn both compressors OFF, to turn first compressor 12 ON, to turn the second compressor 22 ON or to turn both the first compressor 12 and the second compressor 22 OFF, thereby adjusting the total thermal output of the air conditioning system 10.

At step 210, the Damper Control Procedure is called. Depending on the state variables for each room, the Damper Control Procedure is operative to increase or decrease the fraction open for the dampers in each of the rooms, thereby increasing or decreasing the flow of conditioned air to each of the rooms 50, 52 and 54.

At step 212, the Bypass Damper procedure is called. Depending on the pressure in the main duct 44, the Bypass Damper Procedure is operative to increase or decrease the fraction opening of the bypass damper 74, thereby maintaining a substantially constant pressure in the main duct 44.

At step 214, the Blower Control Procedure is called. Depending on the total requirement for air flow, the Blower Control Procedure is operative to turn the blower motor 42 OFF, rotate the blower motor 42 at the low blower speed, rotate the blower motor 42 at the intermediate blower speed or rotate the blower motor 42 at the high blower speed.

At step 216, the External Fan Control Procedure is called. Depending on the temperature of the refrigerant, the External Fan Control Procedure is operative to increase or decrease the speed of the external fan motor 34 so as to maintain a substantially constant temperature of the refrigerant as it enters the first heat exchanger 14 and the second heat exchanger 24.

At step 218, the room temperature controllers 102, 104 and 106 are queried to determine if the system OFF switch 140 for any of the room controllers has been activated. If the answer is YES, the Exit Procedure, step 220, is called. If the answer is NO, then the control program returns to step 204, thereby starting the main control loop again.

Figure 5:
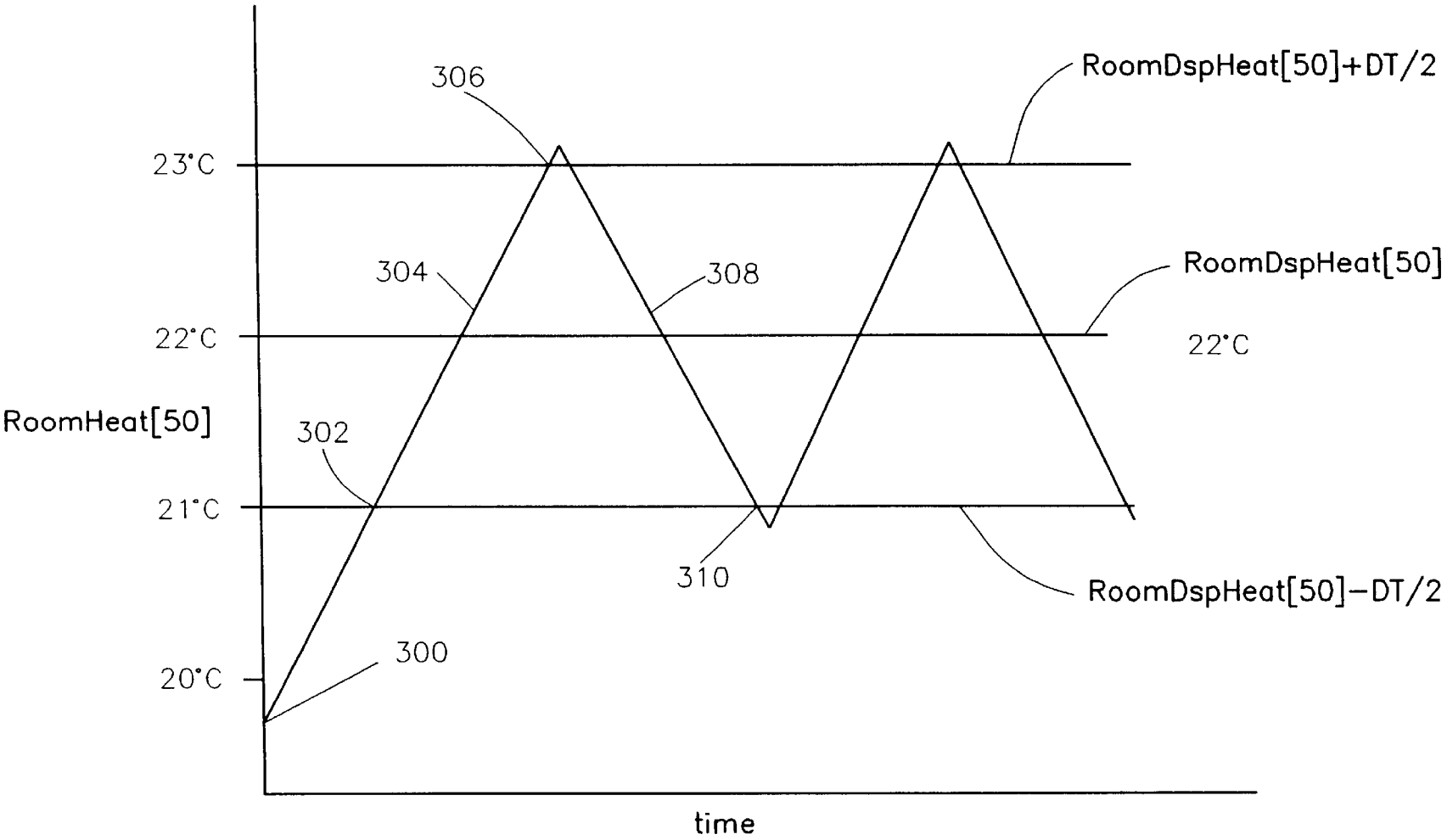
FIG. 5 is a graphical illustration of the temperature in one of the rooms as a function of time.

Reference is also made to FIG. 5 which is a graphical illustration of the temperature variation in room 50 as a function of time, as described hereinbelow. The initial state of room 50 is at point 300.

Figure 6:
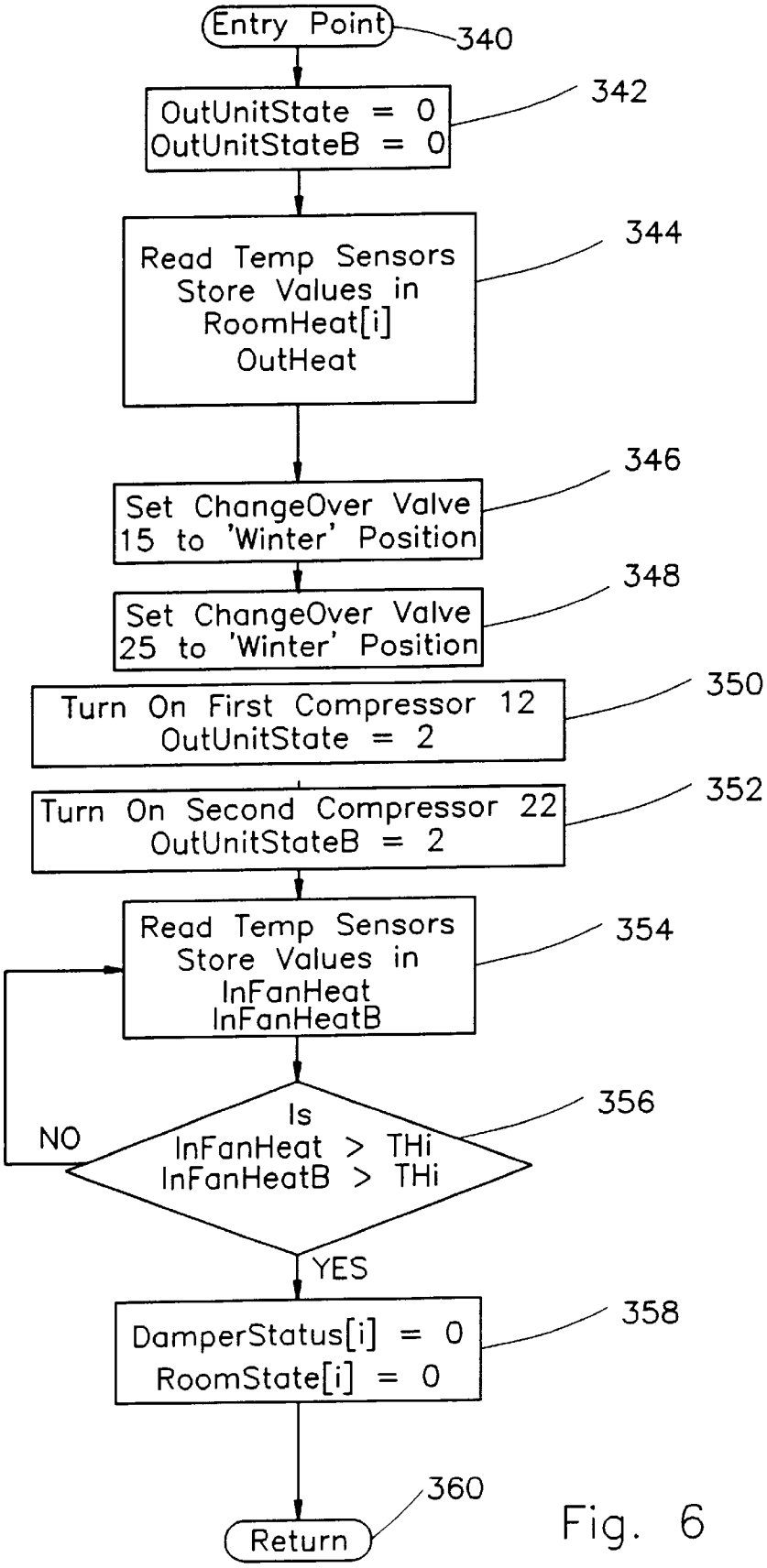
FIG. 6 is a simplified flow chart of an Initialize State Variables Procedure useful in controlling the air conditioning system of FIG. 1.

Reference is now also made to FIG. 6 which is a simplified flow chart of the Initialize State Variables Procedure useful in controlling the air conditioning system of FIG. 1.

Step 340 represents the entry point to the Initialize State Variables Procedure. At this point, the control system 100 is operative to determine that the air conditioning system 10 must operate in heating for 'winter operation'. The logic used to determine whether the air conditioning system 10 is to operate in cooling for 'summer operation'and for heating in 'winter operation' is well known in the art and is not shown in the Initialize State Variables Procedure.

At step 342 the first and second compressor state variables OutUnitState and OutUnitSiateB are set to 0.

At step 344, the control system 100 is operative to decode the temperatures in rooms 50, 52 and 54 and to store these values in variables RoomHeat[i]. The control system 100 is also operative to read the temperature of the outside air and store this value in OutHeat.

At step 346, control system 100 is operative to turn the first changeover valve 15 to the 'winter' position.

At step 348, control system 100 is operative to turn the second changeover valve 25 to the 'winter' position.

At step 350, the control system 100 is operative to turn the first compressor 12 ON and to set the first compressor state variable OutUnitState to 2, indicating that the first compressor 12 is operating to pump heat from the first heat exchanger 14 to the third heat exchanger 16, thereby raising the temperature of the refrigerant as it enters the third heat exchanger 16.

At step 352, the control system 100 is operative to turn the second compressor 22 ON and to set the second compressor state variable OutUnitStateB to 2., indicating that the second compressor 22 is operating to pump heat from the second heat exchanger 24 to the fourth heat exchanger 26, thereby raising the temperature of the refrigerant as it enters the fourth heat exchanger 26.

At step 354, the control system 100 is operative to read the third temperature signal from the third temperature sensor 118 located at the entrance to the third heat exchanger 16 and store this value in the variable InFanHeat. The control system 100 is also operative to read the fourth temperature signal from the fourth temperature sensor 120 located at the entrance to the fourth 26 heat exchanger 16 and store this value in the variable InFanHeatB.

At step 356, the temperature variables InFanHeat and InFanHeatB are compared with the reference temperature value THi. If InFanHeat and InFanHeatB are both less than THi, then the third heat exchanger 16 and the fourth heat exchanger 26 have not yet reached an appropriate operating point and the control system 100 is operative to return to step 354.

If InFanHeat and InFanHeatB are both greater than THi, then control system 100 is operative to pass control to step 358.

It is apparent that the control system 100 remains in the loop comprising steps 354 and steps 356 until the second and third heat exchangers reach the correct operating temperature as determined by THi.

At step 358, the control system 100 is operative to set the DamperStatus[i] variable for the dampers 56, 58 and 60 in each of the rooms 50, 52 and 54 and for the bypass damper 74. Since the air conditioning system 10 always starts with all of the dampers fully closed, the DamperStatus[i] variable are all set to 0. Control system 100 is also operative to set the RoomStatus[i] for each of the rooms 50, 52, 54 to 0, indicating that that rooms are not at present receiving any conditioned air.

At step 360, control returns to the main control program of FIG. 4.

Figure 7:
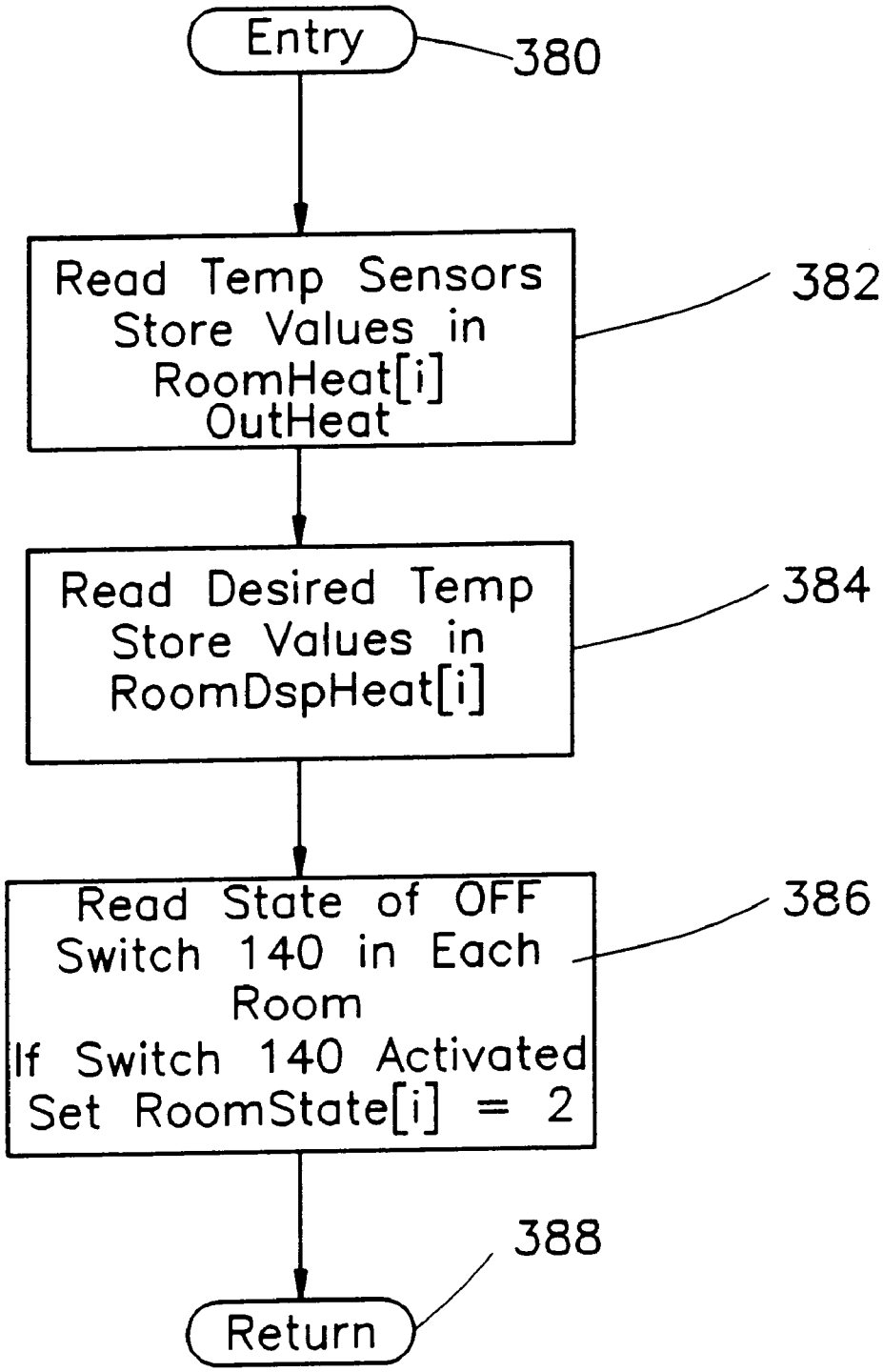
FIG. 7 is a simplified flow chart of a Monitor and Store Values Procedure useful in controlling the air conditioning system of FIG. 1.

Reference is now also made to FIG. 7 which is a simplified flow chart of the Monitor and Store Values Procedure useful in controlling the air conditioning system of FIG. 1.

Step 380 is the entry point into the Monitor and Store Values Procedure. At step 382, the control system 100 is operative to sample the data from the room temperature controllers 102, 104 and 106 and store the desired temperature of each room in RoomHeat[i]. Control system 100 is also operative to read the ambient temperature and from outside temperature sensor 112 and store the value in the variable OutHeat.

At step 384, the control system 100 is operative to sample the data from the room temperature controllers 102, 104 and 106 and store the desired temperature in each room in the variable RoomDspHeat[i].

At step 386, the control system 100 is operative to sample the data from the room controllers 102, 104 and 106 and store the status of the OFF switch 140 in each of the room rooms 50, 52 and 54. If the OFF switch 140 for room i has been activated, the variable RoomState[i] is set equal to 2, indicating that the room has been turned OFF and is not to receive any conditioned air.

At step 388, the control returns to the main control program of FIG. 4.

Figure 8:
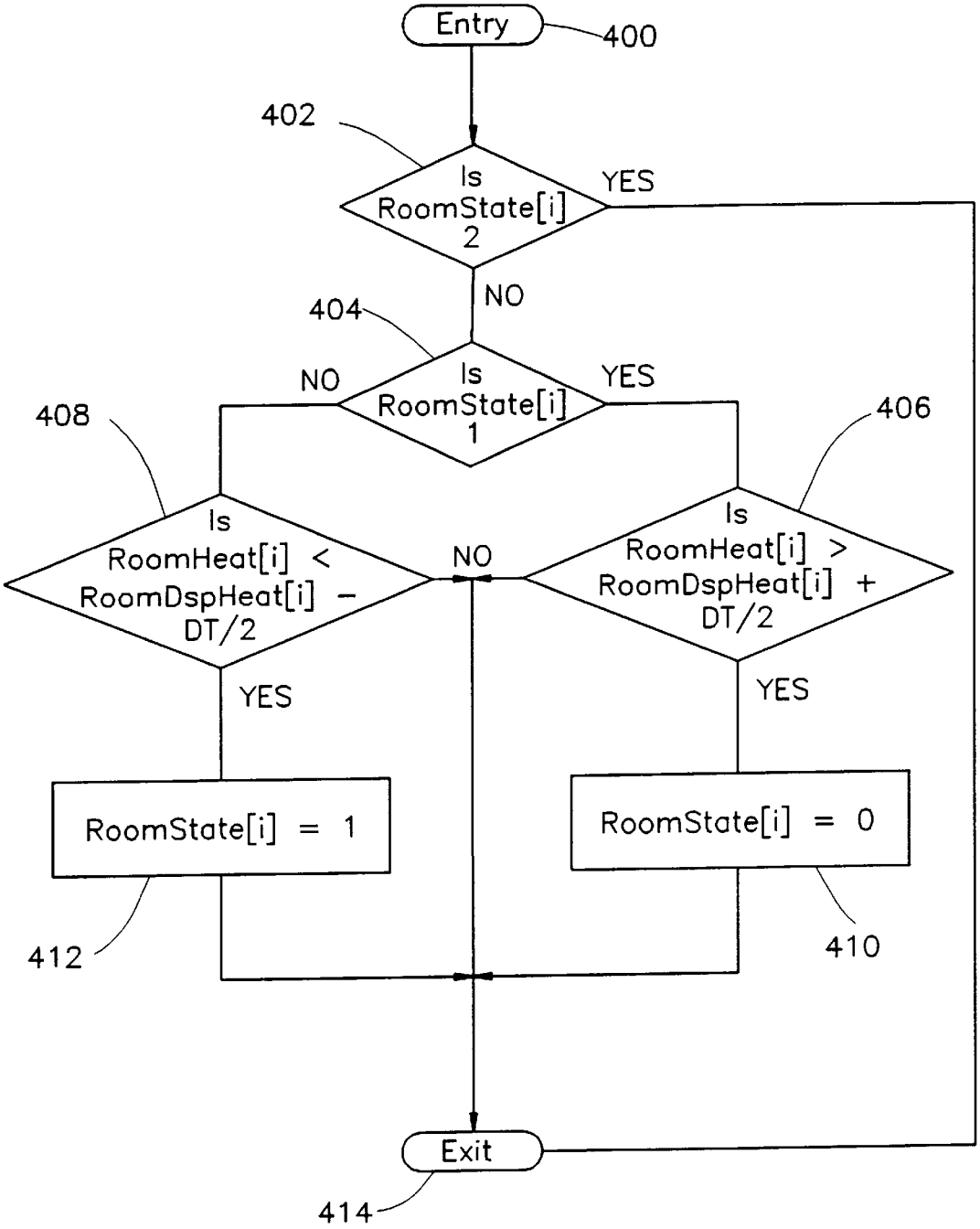
FIG. 8 is a simplified flow chart of a Set State Variables Procedure useful in controlling the air conditioning system of FIG. 1.

Reference is now also made to FIG. 8 which is a simplified flow chart of the Set State Variables Procedure useful in controlling the air conditioning system of FIG. 1.

Step 400 is the entry point into the Set State Variables Procedure. The Set State Variables Procedure is executed for each of the rooms 50, 52 and 54. At state 402, the value of RoomState[i] is determined. If RoomState[i]=2, then room i has been turned off and no conditioned air is to be supplied to that room and control is transferred to step 414, the exit point of the Set State Variables Procedure.

If RoomState[i] is not equal to 2, then room i may receive conditioned air and control is transferred to step 404.

At step 404, if RoomState[i]=1, then conditioned air is already being provided to room i and control is transferred to step 406. At step 406, the measured room temperature RoomHeat[i] is compared with the desired temperature of room i, RoomDspHeat[i], plus the hysteresis DT/2. If the measured temperature of room i, RoomHeat[i], is greater than RoomDspHeat[i]+DT/2, then room i has reached the high value of the hysteresis range and the flow of conditioned air to room i may be stopped. Control is transferred to step 410 and RoomState[i] is set to 0. Control is then transferred to step 414, the exit point of the Set State Variables Procedure.

If the answer to step 406 is NO, then room i has not yet reached the desired temperature and control is transferred to step 414, the exit point of the Set State Variables Procedure. It is apparent that in this case, RoomState[i] remains equal to 1.

Returning now to step 404, if RoomState[i] is not equal to 1, control is transferred to step 408. The measured temperature of room i, RoomHeat[i], is compared with the desired temperature of room i, RoomDspHeat[i], minus the hysteresis DT/2. If the measured temperature of room i, RoomHeat [i], is less than RoomDspHeat[i]−DT/2, then room i has fallen to the low value of the hysteresis range. Control is then transferred to step 412 and RoomState[i] is set to 1.

If the answer to step 408 is NO, then the temperature of room i has not reached the low level of the hysteresis range. Control is transferred to step 414, the exist point of the Set State Variables Procedure. It is apparent that in this case, RoomState[i] remains set to 0.

Figure 9A:
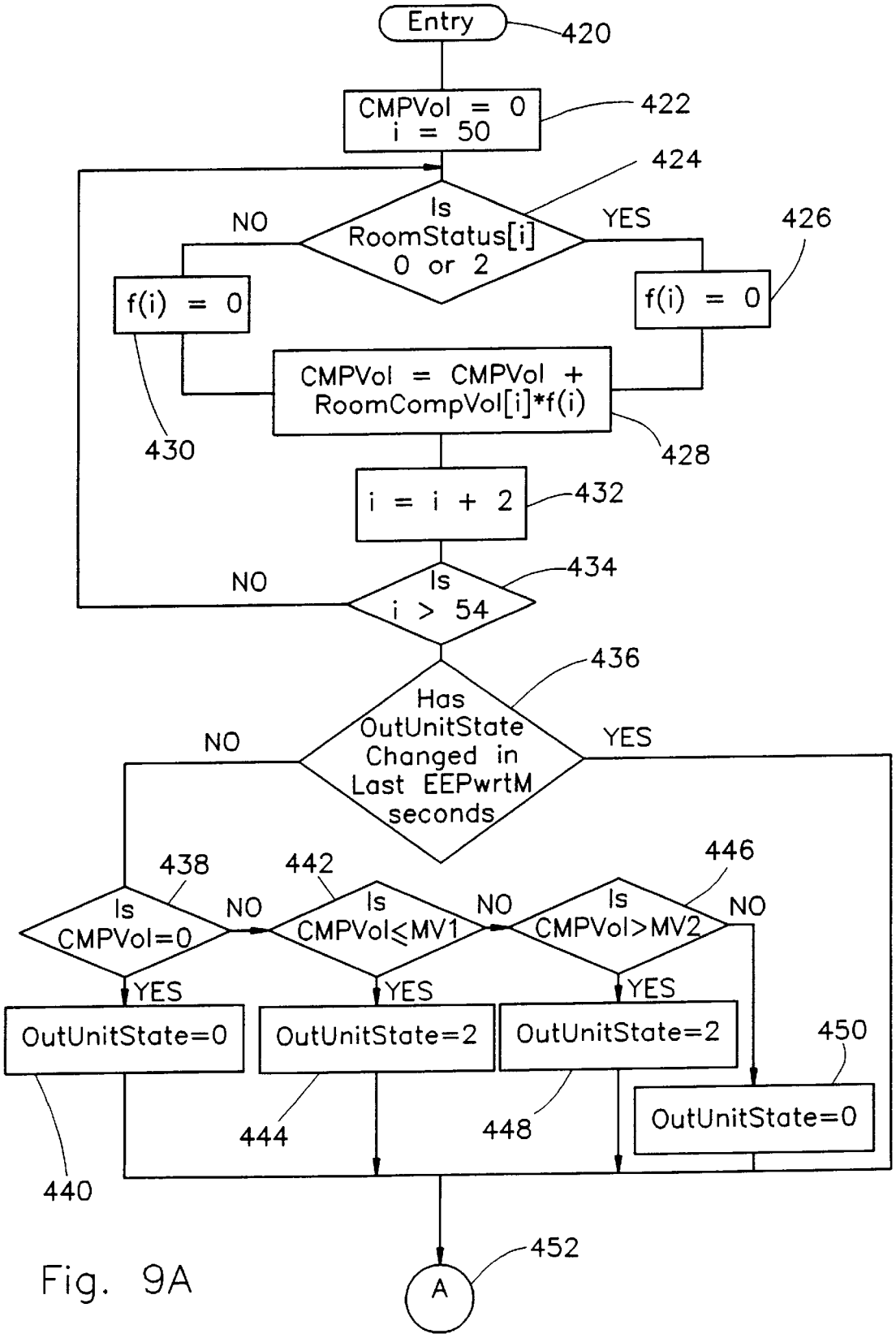
FIGS. 9A and 9B taken together represent a simplified flow chart of a Compressor Control Procedure useful in controlling the air conditioning system of FIG. 1.
Figure 9B:
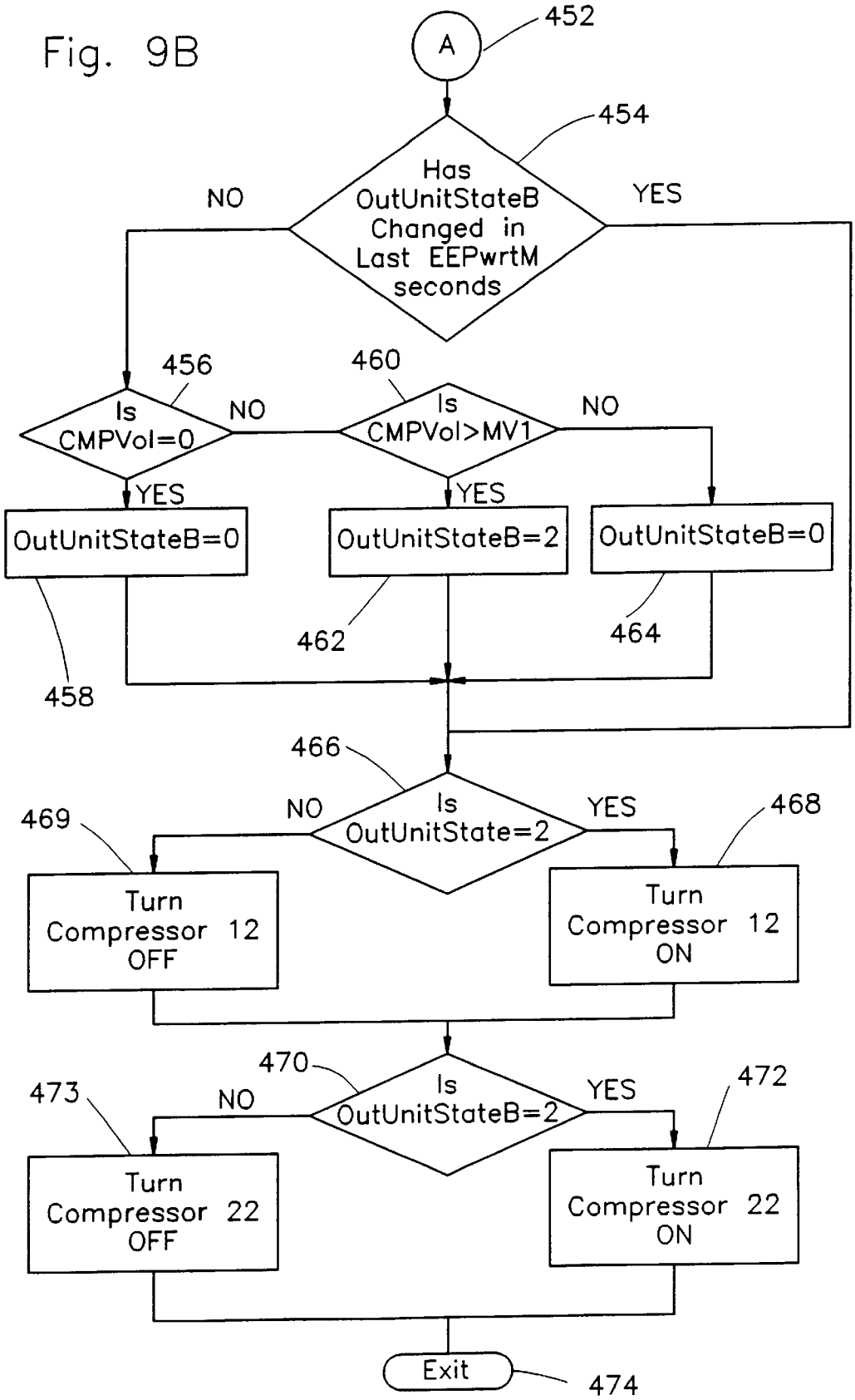

Reference is now also made to FIGS. 9A and 9B taken together represent a simplified flow chart of a Compressor Control Procedure useful in controlling the air conditioning system of FIG. 1. The entry point of the Compressor Control Procedure is at step 420. At step 422, the variable CMPVol is set to 0 and the room counter i is set to 50.

At step 424, a test is made on RoomStatus[i]. If RoomStatus[i] is 0 or 2, then room i does not require any conditioned air and the function f(i) is set to 0 at step 426. If RoomStatus[i] is not 0 or 2, then room i does require conditioned air and the function f(i) is set to 1 at step 430

At step 428, the value of CMPVol is summed. At step 432, the room counter i is incremented and at step 434, a test is made to see if all CMPVol has been summed for all the rooms.

It is apparent that in steps 422 to 434, the total room thermal load CMPVol is calculated.

At step 436, a test is made to see if the first compressor 12 has changed its operating state in the last EEPwrtM seconds. If the first compressor has been turned ON or OFF in the last EEPwrtM seconds, then control transfers to step 452. It is apparent that step 436 prevents rapid ON or OFF cycling of the first compressor 12.

Returning now to step 436, if the operating state of the first compressor 12 has not been changed in the last EEPwrtM seconds, control is transferred to step 438. If the total room thermal load is 0, the OutUnitState is set to 0 at step 440, indicating that the first compressor 12 is to be turned OFF.

Returning now to step 438, if the total room thermal load is greater than 0, control is transferred to step 442. At step 442, if the total thermal load CMPVol is less than MV1, then the total thermal load of all the rooms is small and OutUnitState is set to 2 at step 444, indicating that the first compressor 12 is to be turned ON.

Returning now to step 442, if the total room thermal load is greater than MV1, control is transferred to step 446. At step 446, if the total thermal load is greater than MV2, then the total thermal load of all the rooms is high and OutUnitState is set to 2 at step 448.

Returning now to step 446, if the total thermal load of all the rooms is less than MV2, then the total thermal load of all the rooms is at an intermediate value and OutUnitState is set to 0 at step 450.

After OutUnitState has been set at either of the steps 440, 444, 448 or 450, control is transferred to step 452, which represents a continuation step.

At step 454, a test is made to see if the second compressor 22 has changed its operating state in the last EEPwrtM seconds. If the second compressor 22 has been turned ON or OFF in the last EEPwrtM seconds, then control transfers to step 466. It is apparent that step 454 prevents rapid ON or OFF cycling of the second compressor 12.

Returning now to step 454, if the operating state of the second compressor 22 has not been changed in the last EEPwrtM seconds, control is transferred to step 456. If the total room thermal load is 0, the OutUnitStateB is set to 0 at step 448, indicating that the second compressor 22 is to be turned OFF.

Returning now to step 456, if the total room thermal load is greater than 0, control is transferred to step 460. At step 460, if the total thermal load CMPVol is greater than MV1, then the total thermal load of all the rooms is at an intermediate value or a high value and OutUnitStateB set to 2 at step 462, indicating that the second compressor 22 is to be turned ON.

Returning now to step 460, if the total room thermal load is less than MV1, then the total thermal load of all the rooms is at a low value and OutUnitStateB is set to 0 at state 464.

At step 466, a test is made on OutUnitState. If OutUnitState=2, the control system 100 is operative to turn the first compressor 12 ON at step 468. If OutUnitState=0, then control system 100 is operative to turn the first compressor 12 OFF at step 469.

At step 470, a test is made on OutUnitStateB. If OutUnitStateB=2, the control system 100 is operative to turn the second compressor 22 ON at step 472. If OutUnitStateB=0, then control system 100 is operative to turn the second compressor 22 OFF at step 473.

It is apparent that the Compressor Control Procedure is operative to turn the first compressor 12 ON if the total thermal load of all the rooms is low. It is also apparent that the Compressor Control Procedure is operative to turn the second compressor 22 ON if the total thermal load of all the rooms is at an intermediate value. It is also apparent that the Compressor Control Procedure is operative to turn both the first compressor 12 and the second compressor 22 ON if the total thermal load of all the rooms is at a high value.

After the operating state of the first compressor 12 and the second compressor 22 have been set, control is transferred to step 474, which is the exit point of the Compressor Control Procedure.

Figure 10:
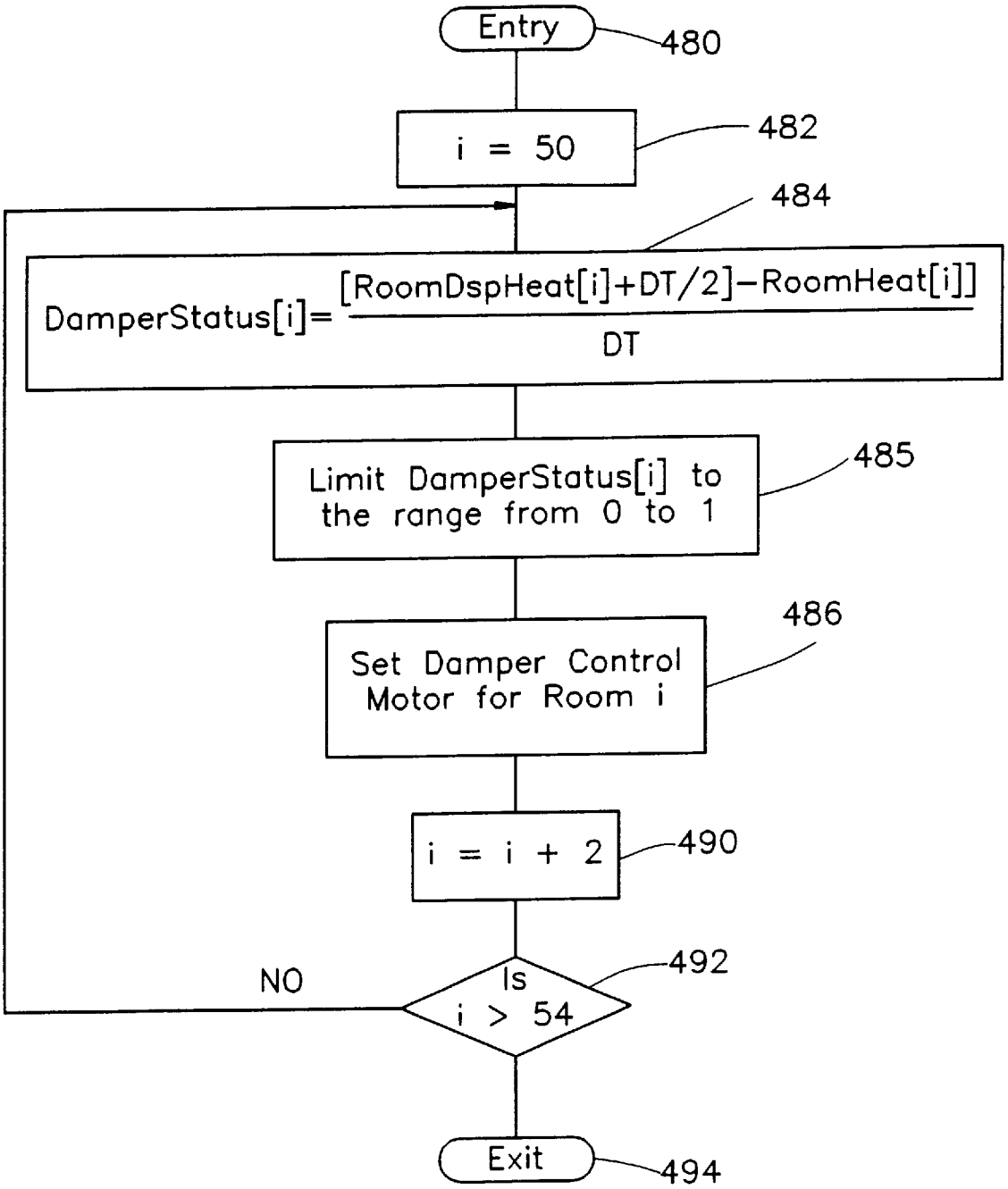
FIG. 10 is a simplified flow chart of a Damper Control Procedure useful in controlling the air conditioning system of FIG. 1.

Reference is now made to FIG. 10 which is a simplified flow chart of a Damper Control Procedure useful in controlling the air conditioning system of FIG. 1. The entry point into the Damper Control Procedure is at step 480.

At step 482, the room counter i is set equal to 50. At step 484, the required opening of the damper for room i is calculated in terms of the measured room temperature RoomHeat[i], the desired temperature of room i, RoomDspHeat[i] and the hysteresis value DT as described hereinabove.

At step 485, the value of the DamperStatus[i] is limited to the range from 0 to 1. Thus, if the result of the calculation of step 484 is less than 0, then DamperStatus[i] is set to 0. Similarly, if the result of the calculation of step 484 is greater than 1, then DamperStatus[i] is set to 1

At step 486, the control system 100 is operative to adjust the fraction opening of the damper for room i according to the just calculated value of DamperStalus[i].

At step 490, the room counter i is incremented and at step 492, a test is made to determine if all of the rooms have been covered. If all the rooms have not been covered, control returns to step 484 where the damper for the next room is adjusted.

If all of the rooms have been covered, control transfers to step 494 which is the exit point of the Damper Control Procedure.

Figure 11:
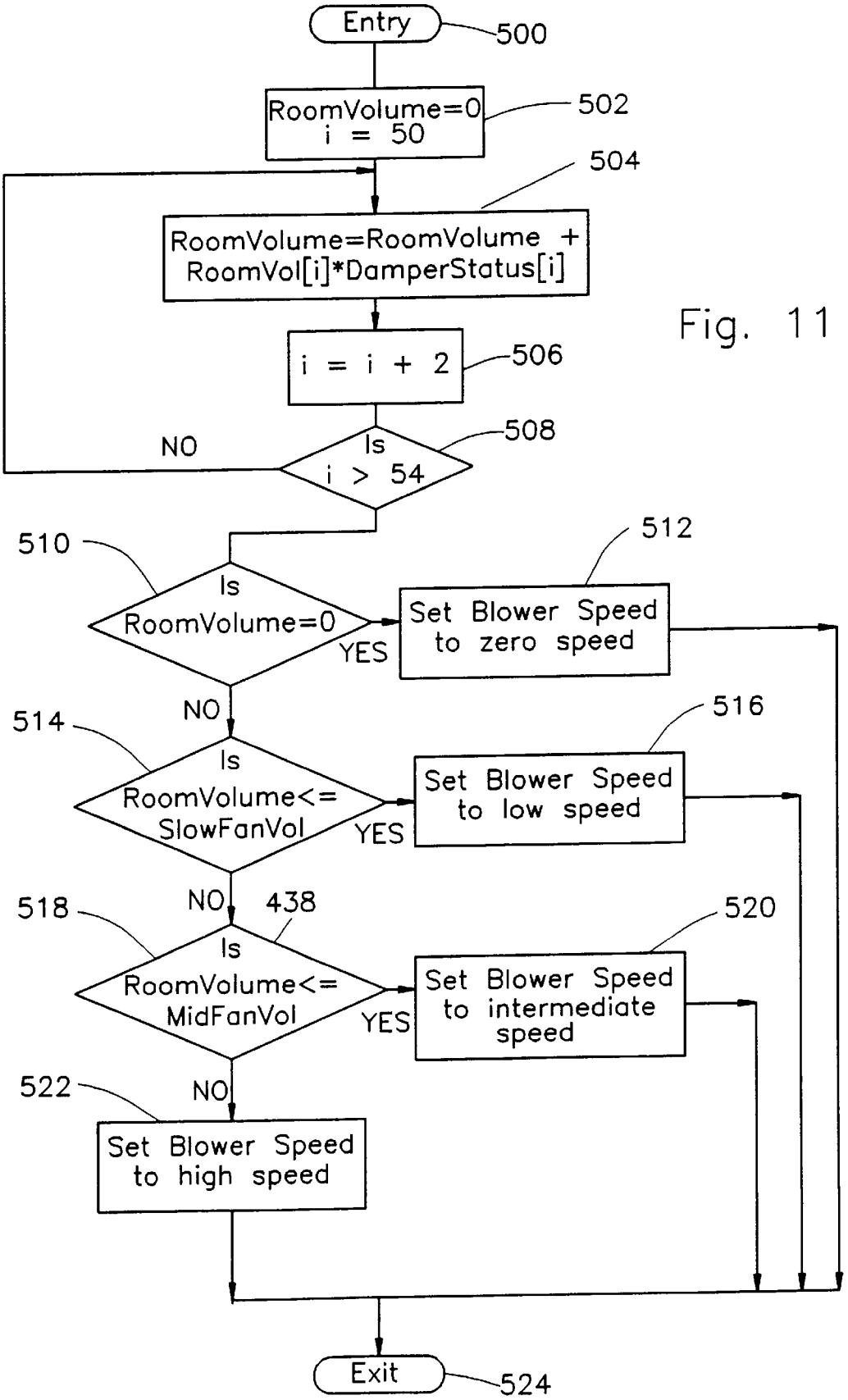
FIG. 11 is a simplified flow chart of a Blower Control Procedure useful in controlling the air conditioning system of FIG. 1.

Reference is now made to FIG. 11 which is a simplified flow chart of a Blower Control Procedure useful in controlling the air conditioning system of FIG. 1. The entry point into the Blower Control Procedure is at step 500. In steps 502 to 508, the total air flow requirement for all of the rooms, RoomVolume, is calculated by summing up the individual air flow requirement of all of the rooms.

In step 510, a test is made to determine if the total air flow required is 0. If it is, the control system is operative to turn the blower motor 42 OFF at step 512, in which case control is passed to step 524, the exit point of the Blower Control Procedure.

If the total air flow required is greater than 0 but less than or equal to SlowFanVol, control is transferred to step 516 wherein control system 100 is operative to set the speed of the blower motor 42 to the low blower speed. Control is passed to step 524, the exit point of the Blower Control Procedure.

If the total air flow required is greater than SlowFanVol but less than or equal to MidFanVol, control is transferred to step 520 wherein control system 100 is operative to set the speed of the blower motor 42 to the high blower speed. Control is passed to step 524, the exit point of the Blower Control Procedure.

It is apparent that the Blow Control Procedure is operative to adjust the speed of the blower motor 42 in response to the total air flow requirement of all of the rooms.

It is also apparent that the Blow Control Procedure may be operative to adjust the speed of the blower motor 42 in a continuous manner.

It is also apparent that the air conditioning system 10 of FIG. 1 may also be implemented with a single compressor.

Operation of the central air conditioning system is now be described for 'winter operation'. In the following description, it is assumed, by way of example, that the initial temperature of each room is less than 20° C. and that the desired temperature of each room i, RoornDspHeat[i], is 22° C. The air conditioning system is OFF and the ON/Enter switch 138 has been activated on room thermostat 102 of room 50. It is also assumed that the temperature hysteresis DT is set a 2° C. Referring once again to FIG. 5, the starting point of operation is at point 300.

Because the temperatures of all the rooms are below 21° C., the total thermal requirement of all of the rooms is at the highest value and both the first compressor 12 and the second compressor 22 are turned ON.

After the first and second compressors reach the desired operating conditions, the dampers motors 62, 64 and 66 are set to the full open position to allow the maximum amount of conditioned air into each of the rooms. Since all of the dampers 56, 58 and 60 are fully open, the total air flow requirement is at a high value and the speed of the blower motor 42 is set at its highest value. The speed of the external fan motor 34 is also set at its highest value.

As conditioned air enters each of the rooms, the temperature increases until point 302 is reached. Both compressors continue operating, thereby increasing the room temperature to point 304. As the temperature in each room increases, the damper for that room is gradually closed until point 306 is reached, at which point the damper is fully closed.

As the dampers begin to close, the speed of the blower motor 42 may be decreased to match the air flow requirement of all of the rooms.

When point 306 is reached for a room, the damper for that room is fully closed and conditioned air is no longer required for that room. The thermal load of the room is removed from the total thermal load of all of the rooms and the first compressor 12 may be turned OFF. As more of the rooms reach point 306, the total thermal load of all the rooms decreases until the second compressor is turned ON and the first compressor 12 turned OFF. If the total thermal load decreases still further, only the first compressor 12 is turned ON.

If all of the rooms are at the desired temperature plus hysteresis of 23° C., the total thermal load of all the rooms is 0 and both compressors are turned OFF.

As the supply of conditioned air to each of the rooms stops after point 306 is reached, the temperature of each of the rooms begins to decrease and pass through points 308 and 310. Once point 310 is reached, the supply of conditioned air must start once again and the thermal load of the room is then added to the total thermal load of all of the rooms.

It is appreciated that the air conditioning system 10 is operative to optimize the operation of both compressors, the blower motor 42, the dampers 56, 58 and 60 and the external fan 26 to minimize overall energy consumption while maintaining the temperature of all of the rooms within the desired operating range.

It is also appreciated that the air conditioning system 10 is operative to provide cooling air during 'summer operation'.

It is appreciated by persons skilled in the art that the present invention in not limited by what has been particularly shown and described hereinabove. Rather, the scope of the invention is defined only by the claims which follow:

We claim:

1. An air conditioning system comprising:

at least first and second compressors;

at least first and second heat exchangers associated respectively with said at least first and second compressors;

at least third and fourth heat exchangers in refrigerant fluid communication respectively with said at least first and second heat exchangers , said at least third and fourth heat exchangers also being in heat exchange communication with a stream of air to be conditioned;

an air flow pathway arranged to receive said stream of air downstream of said third and fourth heat exchangers and to direct it to a plurality of enclosures via a plurality of air outlets; and a control system operative to selectably operate said at least first and second compressors, such that none, all or some of said at least first and second compressors operate at a given time, said control system being operative to control the speed of operation of said first variable speed air blower at least partially responsive to the total heat load in said plurality of enclosures.

2. An air conditioning system according to claim 1 and wherein:

said plurality of outlets are equipped with individually controllable dampers; and said control system also selectably operates said individually controllable dampers.

3. An air conditioning system according to claim 2 and wherein said control system operates said individually controllable dampers at least partially responsive to a relationship between the heat loads in the plurality of enclosures.

4. An air conditioning system according to claim 1 and wherein said control system selectably operates said at least first and second compressors at least partially responsive to the total heat load in said plurality of enclosures.

5. An air conditioning system according to claim 1 and also comprising a first variable speed air blower assembly operative to force air past said at least third and fourth heat exchangers.

6. An air conditioning system according to claim 5 and also comprising a second variable speed air blower assembly operative to force air past said at least first and second heat exchangers.

7. An air conditioning system comprising:

at least one compressor;

at least one first exchanger associated respectively with said at least one first compressor;

at least one second heat exchanger in refrigerant fluid communication respectively with said at least first heat exchanger, said at least one second heat exchanger also being in heat exchange communication with a stream of air to be conditioned;

an air flow pathway arranged to receive said stream of air downstream of said at least second heat exchanger and to direct it to a plurality of enclosures via a plurality of air outlets equipped with individually controllable dampers; and a control system operative to selectably operate said at least one first compressor and said individually controllable dampers, at least partially responsive to the relationship between the heat loads in the plurality of enclosures, said control system being operative to control the speed of operation of said first variable speed air blower at least partially responsive to the total heat load in said plurality of enclosures.

8. An air conditioning system according to claim 7 and wherein said control system selectably operates said at least one compressors at least partially responsive to the total heat load in said plurality of enclosures.

9. An air conditioning system according to claim 7 and also comprising a first variable speed air blower assembly operative to force air past said at least one second heat exchanger.

10. An air conditioning system according to claim 9 and also comprising a second variable speed air blower assembly operative to force air past said at least one first heat exchanger.

11. An air conditioning system according to claim 7 and also comprising a data port communicating with said control system to permit external programming and monitoring of the operation thereof.

* * * * *